US006056541A

United States Patent [19]

Gerszewski

[11] Patent Number: 6,056,541

[45] Date of Patent: May 2, 2000

[54] CANDLE APPARATUS

[76] Inventor: David Gerszewski, 1711 21st Ave. S., Grand Forks, N. Dak. 58201

[21] Appl. No.: 09/418,280

[22] Filed: Oct. 14, 1999

[51] Int. Cl.[7] ..... F23D 3/02

[52] U.S. Cl. ..... 431/288

[58] Field of Search ..... 431/288

[56] References Cited

U.S. PATENT DOCUMENTS 1,484,964 2/1924 Rhodes ..... 431/288
3,730,674 5/1973 Gross ..... 431/288
5,567,145 10/1996 White ..... 431/288

*Primary Examiner*—Carroll Dority
*Attorney, Agent, or Firm*—Robert E. Kleve

[57] ABSTRACT

The invention comprises a candle device having a wax body having a center hole therethrough. A single elongated wick is formed into a loop with its intermediate portions with the loop surrounding the center hole while imbedded in the wax, and with the remote ends of the wick protruding through the top of the wax and adjacent one another so that both ends of the wick may be ignited at the same time and the candle thereby burning at both ends in accordance with an expression to that effect.

4 Claims, 1 Drawing Sheet

CANDLE APPARATUS

This invention relates to candles, more particularly, the invention relates to candles having a wax with an elongated wick immersed in the wax with the ends of the wick enabling both ends of the candle to be ignited and burned simultaneously.

It is an object of the invention to provide novel candle having wax with an opening in the wax and with an elongated wick looped in the wax about the opening in the wax and with the ends of the wick outside the wax to enable both ends of the candle to be ignited and burned at the same time.

It is a further object of the invention to provide a novel candle for symbolizing the expression of burning both ends of the candle at the same time.

It is another object of the invention to provide a novel candle to enable both ends of the wick to be ignited.

It is another object of the invention to provide a novel candle hating a particular shape to symbolize literary expression.

Further objects and advantages of the invention will become apparent as the description proceeds and when taken in conjunction with the accompanying drawing wherein:

BRIEF DESCRIPTION OF THE PREFERRED EMBODIMENT

Briefly stated, the invention comprises a candle device having a single wick and a wax body having a center hole, with wax surrounding the center hole. The stick is immersed in the wax body with its intermediate portions surrounding the center hole in the wax body and with its remote ends protruding through the top of the wax and with the ends adjacent one another so that both ends of the wick may be easily ignited simultaneously and with the wick burning down along both sides of the center opening in the wax body to symbolize the expression burning the candle at both ends.

Figure 1:
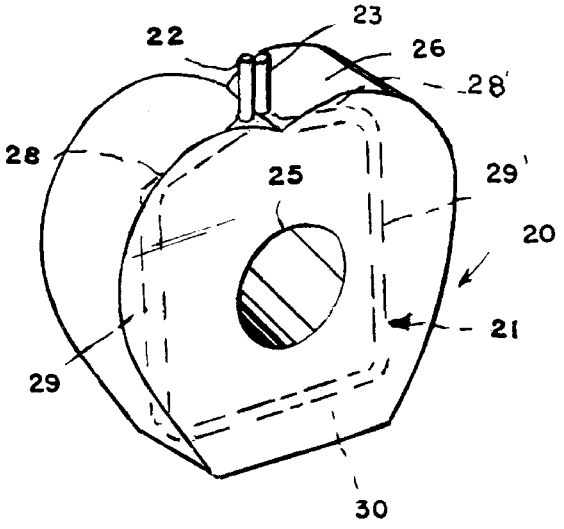
FIG. 1 is a perspective view of the novel candle invention.
Figure 2:
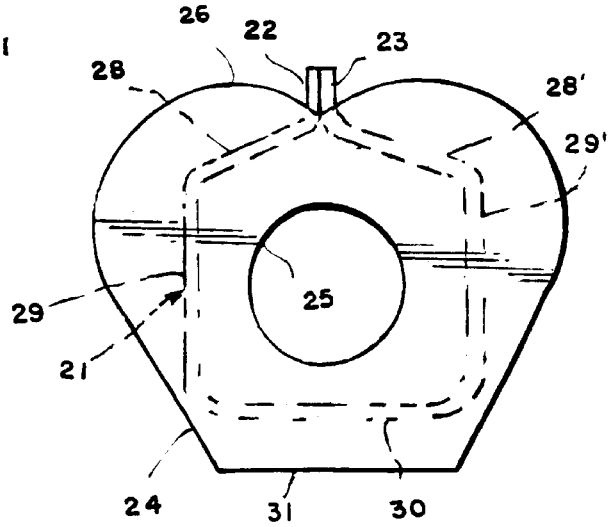
FIG. 2 is a front elevational view of the novel candle invention.
Figure 3:
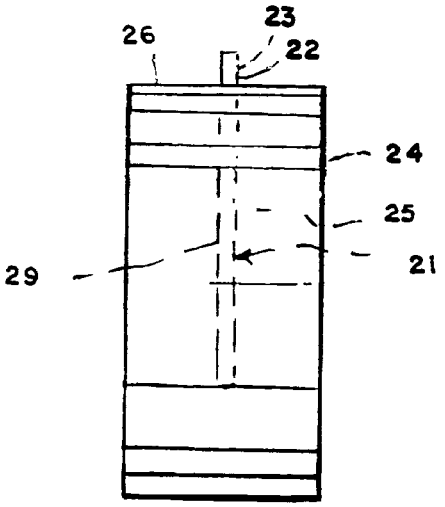
FIG. 3 is an end view of the candle invention.

Referring more particularly to the drawings, in FIGS. 1 and 2 the candle invention 20 is illustrated hag a single elongated wick 21 with remote ends 22 and 23. The candle invention has a wax body 24 with a center hole 25 in the wax body, with intermediate portions of the wick 21 imbedded in the wax body and surrounding the center hole 25 in the wax body, and with the remote ends 22 and 23 of the wick 21 protruding through the top 26 of the wax body 24. The center hole 25 is circular in shape and extends through the middle of the wax body, with the wick 21 surrounding the center hole. The upper intermediate portions 28 and 28' of the wick 21 extend diagonally downward and outward in the wax from the protruding ends of the wick at an angle, while the lower intermediate portions 29 and 29' of the wick 21 extend vertically downward in the wax on opposite sides of the center hole 25 in the wax body, with a horizontal bottom portion 30 extending along the bottom of the hole in the wax. The wick 21 is intended to be positioned vertically in the wax as much as possible in relation to the horizontal bottom or base 31 of the wax body, so as to be vertical when the wax body is placed upright on its base 31 on a horizontal surface and the ends of the wick ignited and burned, since the candle burns better and more efficiently if the wick is positioned vertically in the wax.

The wax body may be made in a variety of shapes and forms with a center hole in the middle of the wax body, so that the wick may extend vertically on each side of the center hole which enables two candle portions to be burned at the same time independently of one another.

Initially, when the two wick ends are lit, only one flame will result. The candle will burn with the one flame as the outer ends of the wick are adjacent one another. After the device has burned for several minutes as one flame, the wick will have burnt down enough to reach the diagonal portions of the wick 28 and 28'. The wick ends will start burning away from one another at this point, as the flame burns down along these diagonal portions of the wick and the flame will separate into two separate flames. The candle will continue burning as two separate flames. While the diagonal portions 28 and 28' of the wick are burned, and also while the vertical portions 29 and 29' of the wick are burned.

The wax may be made in sections by first pouring a wax body, of approximately one half its final thickness with the hold in the middle of the half body section. The wick will be laid or placed on top of the wax section with the ends of the wick extending beyond the top portion of the section. Then, the top half of the wax section will be poured on top of the wick and the lower body section of the wax to complete the manufacture of the candle apparatus.

It will be obvious that various changes and departures may be made to the invention without departing from the spirit and scope thereof, and accordingly, it is not intended that the invention be limited to that specifically described in the specification, or as illustrated in the drawing, but only as set forth in the appended claims wherein:

What is claimed is:

1. A candle apparatus comprising a body of wax formed with center opening and a base at the bottom, a single elongated wick formed into a loop with the looped portion of the wick extending in the wax body about the center opening in the wax body, said wick having remote ends with the remote ends protruding from the wax body at the top thereof, said remote ends of said wick being adjacent one another so that the ends of the wick may be ignited simultaneously to symbolize the expression burning the candle at both ends.

2. A candle apparatus comprising a wax body having outer surfaces vital an opening therethrough intermediate the outer surfaces of the wax body, an elongated wick having its intermediate portions immersed in the wax body about the opening and having remote ends protruding from a surface of the wax body whereby other ends of the wick may be ignited at least substantially at the same time and burned to symbolize burning the candle at both ends.

3. A candle comprising a body of wax having an opening therethrough with said wax surrounding said opening, an elongated wick having remote ends and an intermediate portion with the intermediate portions surrounding said opening and immersed in the wax and with its remote ends protruding from the top of the body of wax.

4. A candle according to claim 3 wherein the intermediate portions of the elongated wick extend substantially vertical in the wax on each side of the opening with a bottom portion of the intermediate portion of the wick extending horizontally along the bottom of the opening.

* * * * *